US007775402B2

(12) United States Patent
Yoshida et al.

(10) Patent No.: US 7,775,402 B2
(45) Date of Patent: Aug. 17, 2010

(54) DISPENSING CONTAINER WITH A PUMP

(75) Inventors: Masumi Yoshida, Nishinomiya (JP); Chiaki Kamimura, Ibaraki (JP); Tsutomu Kobayashi, Ibaraki (JP)

(73) Assignees: The Procter and Gamble Company, Cincinnati, OH (US); Yoshino Kogyosho Co, Ltd., Tokyo (JP)

( * ) Notice: Subject to any disclaimer, the term of this patent is extended or adjusted under 35 U.S.C. 154(b) by 589 days.

(21) Appl. No.: 11/660,949

(22) PCT Filed: Dec. 20, 2005

(86) PCT No.: PCT/JP2005/023352

§ 371 (c)(1),
(2), (4) Date: Feb. 23, 2007

(87) PCT Pub. No.: WO2006/087867

PCT Pub. Date: Aug. 24, 2006

(65) Prior Publication Data

US 2007/0246484 A1 Oct. 25, 2007

(30) Foreign Application Priority Data

Dec. 22, 2004 (JP) ..... 2004-370482

(51) Int. Cl.
*B65D 83/76* (2006.01)

(52) U.S. Cl. ..... 222/153.13; 222/321.3; 222/321.9; 222/384

(58) Field of Classification Search ..... 222/153.13, 222/499, 519, 522, 321.1, 321.7, 321.9, 523, 222/524, 153.1, 383.1, 372, 383.3, 384, 321.3
See application file for complete search history.

(56) References Cited

U.S. PATENT DOCUMENTS

| | | | | |
|---|---|---|---|---|
| 4,991,746 | A * | 2/1991 | Schultz | 222/153.13 |
| 5,004,127 | A * | 4/1991 | Morel | 222/521 |
| 5,421,487 | A * | 6/1995 | Moretti | 222/153.1 |
| 6,193,112 | B1 * | 2/2001 | Santagiuliana | 222/153.13 |
| 6,290,103 | B1 | 9/2001 | Fraillon | |
| 6,477,743 | B1 * | 11/2002 | Gross et al. | 222/525 |

FOREIGN PATENT DOCUMENTS

| | | |
|---|---|---|
| JP | A 6-345164 | 12/1994 |
| JP | A 9-193958 | 7/1997 |
| WO | WO 00/66459 | 11/2000 |

* cited by examiner

*Primary Examiner*—Kevin P Shaver
*Assistant Examiner*—Donnell Long
(74) *Attorney, Agent, or Firm*—Oliff & Berridge, PLC

(57) ABSTRACT

A dispensing container with a pump includes a neck, a manual pump of a push-down type disposed in the neck, a push-down head fitted to the top of the pump, and a cap having an attaching cylinder fitted around the neck. A rotary cylinder is disposed on the outside of the attaching cylinder coaxially on central axis. A cover cylinder having a cover wall is disposed coaxially between the attaching cylinder and the rotary cylinder in a manner capable of going up and down under the condition that an elevating system has been established with the attaching cylinder and the rotary cylinder by the rotary movement of the rotary attachment. The cover cylinder is disposed so the push-down head is exposed out of the cover cylinder at its lower-limit position and cannot be pushed down at the upper-limit position of the cover cylinder to prevent contents from being erroneously discharged.

5 Claims, 6 Drawing Sheets

[Fig. 1]
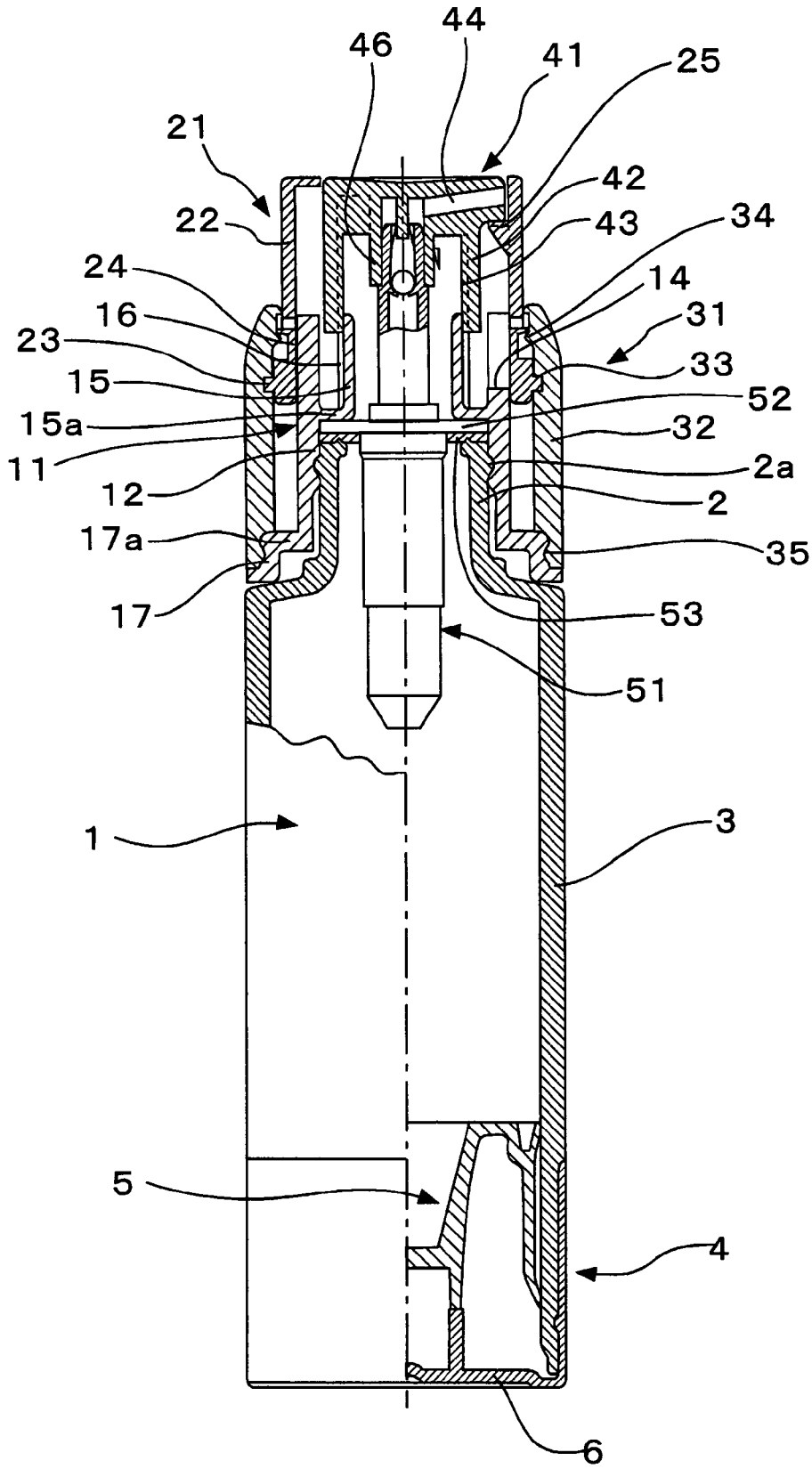

[Fig. 2]
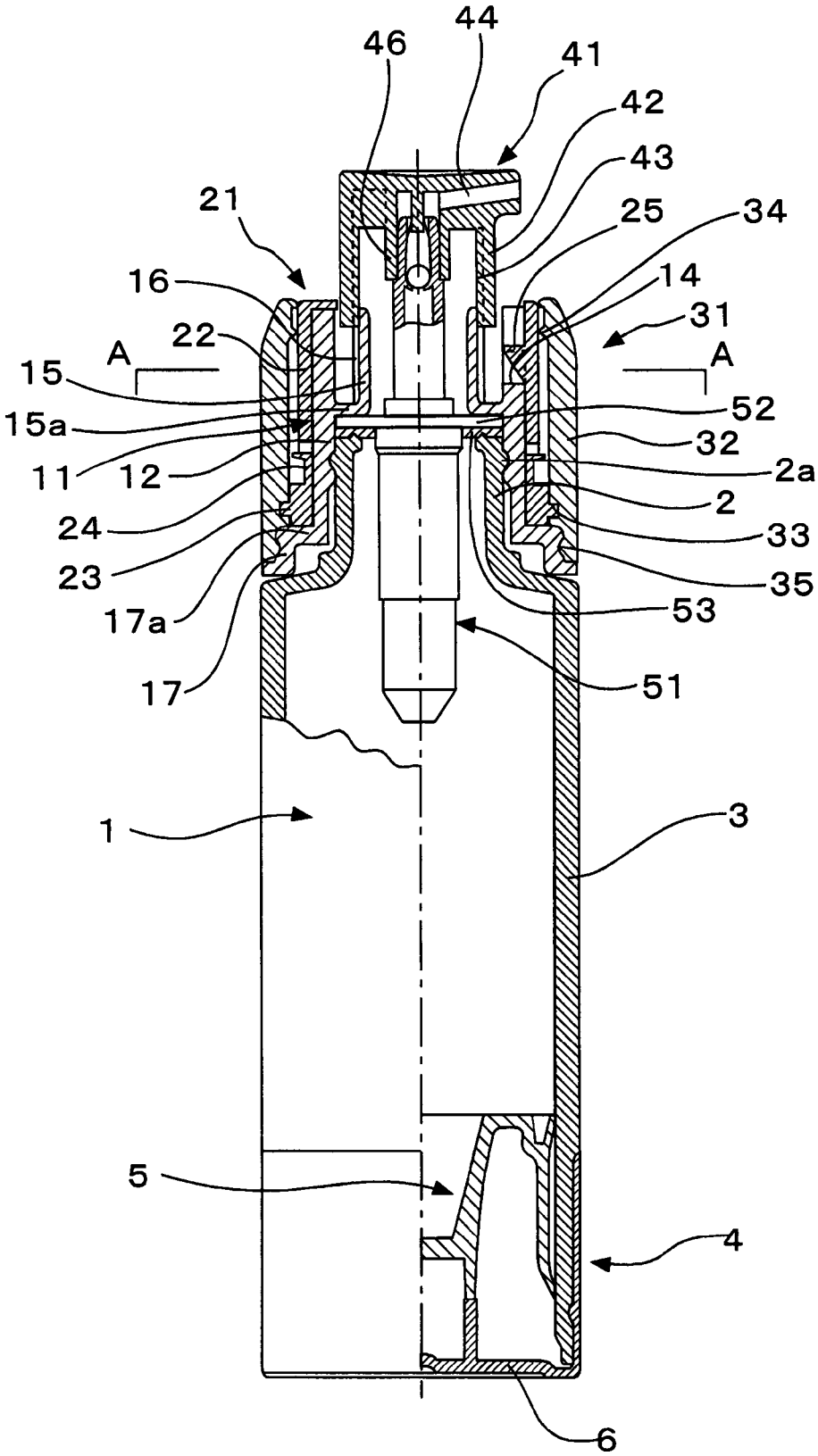

[Fig. 3]
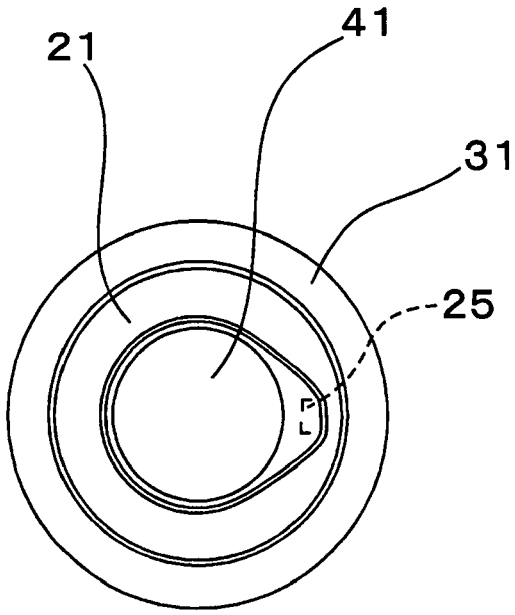
[Fig. 4]
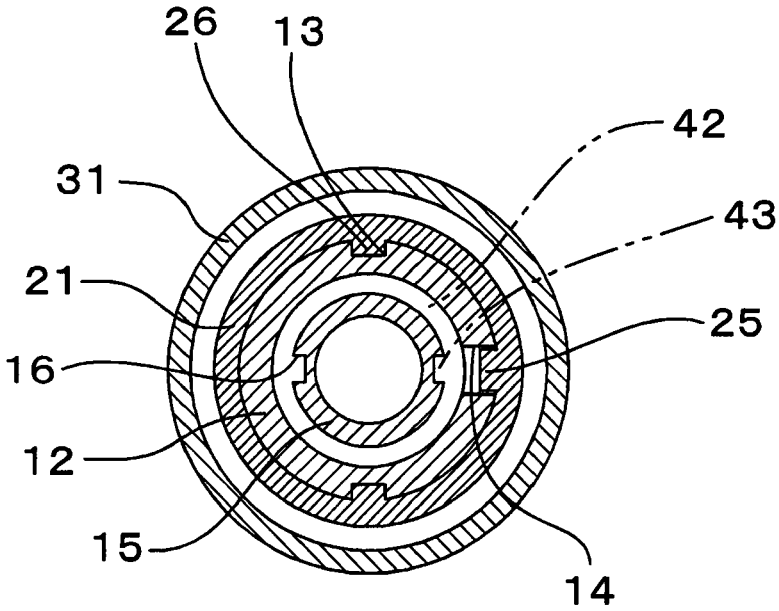

[Fig. 5]
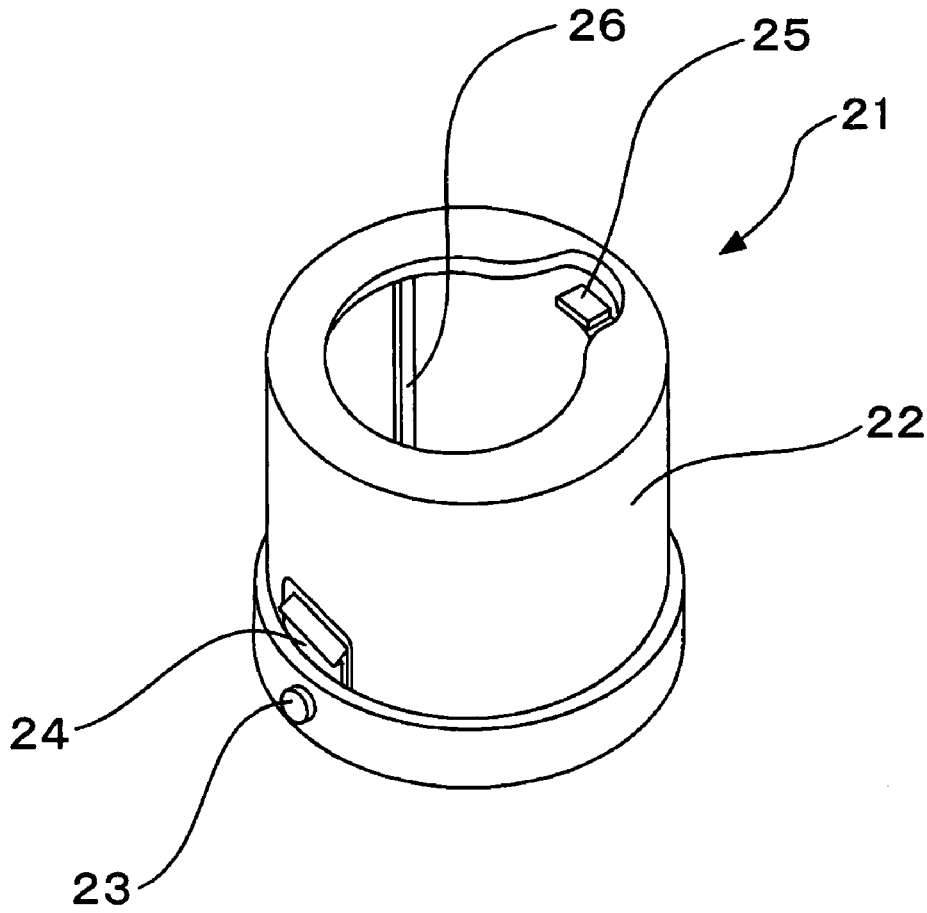

[Fig. 6]
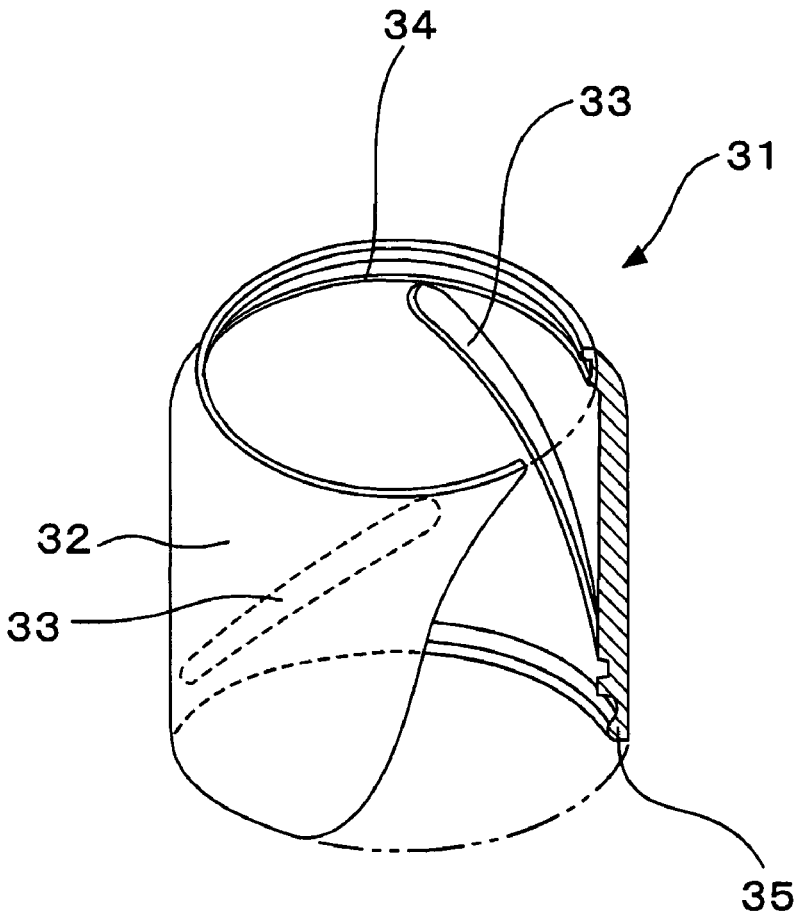

[Fig. 7]
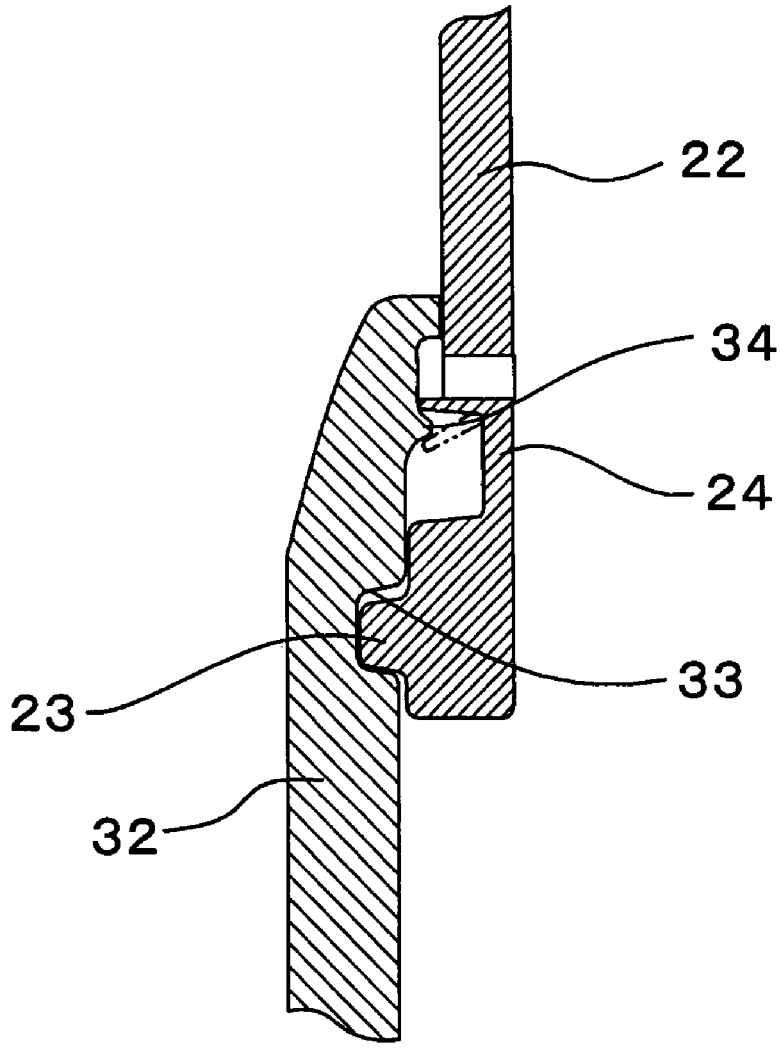

DISPENSING CONTAINER WITH A PUMP

TECHNICAL FIELD

This invention relates to a dispensing container with a pump, wherein a manual pump of a push-down type is fitted to the neck of the container and is used to discharge the contents.

BACKGROUND ART

Japanese Publication Number P1997-193958A, for example, describes an invention related to a dispensing container with a pump. As shown diagrammatically in an example of this patent, such a dispensing container equipped with a pump is usually provided with a push-down head having an inside discharge port at the upper end of the pump to discharge the contents in the lateral direction. When the container is used, the push-down head is pushed down to make the pump piston descend. In many cases, the containers are shipped or stored with a separate head cover on the head from an appearance point of view or with a view to preventing the push-down head from being pushed in an erroneous or wrong operation.

SUMMARY

However, containers with a separate head cover has to be handled with both hands. After the cover is removed, it is temporarily placed on the dressing table or the wash-basin. At that time, it often happens that the cover is missing.

The exemplary embodiments address or solve such an inconvenience. For example, a dispensing container with a pump is provided, which can be used with easy handling, as by discharging the contents while holding the container with one hand, without using any separate head cover, and which has a function for preventing erroneous operation.

In a first exemplary embodiment, a dispensing container with a pump, includes a neck standing in the upper portion of a main container and having a manual pump of a push-down type disposed upright in said neck; a push-down head fitted to the top of said pump; a cap having an attaching cylinder fitted around said neck and having said pump fitted and secured to the neck in a sealed state; a rotary attachment having its lower portion fitted around the lower portion of the cap in a rotatable manner and having a rotary cylinder disposed on the outside of the attaching cylinder coaxially on central axis; and a cover cylinder having a cover wall disposed coaxially between the attaching cylinder and the rotary cylinder in a manner capable of going up and down under the condition that an elevating system has been established with the attaching cylinder and the rotary cylinder by the rotary movement of the rotary attachment, wherein said cover cylinder is set up in such a way that the push-down head is exposed out of the cover cylinder at its lower-limit position but cannot be pushed down at the upper-limit position of the cover cylinder to prevent contents from being discharged by error.

Based on this first exemplary configuration, the attaching cylinder is fitted to the neck of the container, and the cap allows the pump to be disposed upright inside the neck in a sealed state. Thus, it is possible for the dispensing container with a manual pump of the push-down type to perform its function correctly.

The rotary attachment is fitted around the lower portion of the cap in a rotatable manner, and in addition, the cover wall is disposed coaxially between the attaching cylinder and the rotary attachment, under the condition that the rotary cylinder is disposed upright coaxially on the outside of the attaching cylinder. Under this condition, the rotary attachment is rotated around the lower portion of the cap, and the elevating system is formed by the attaching cylinder, the rotary cylinder, and the cover wall so that the cover wall can go up and down.

The cover cylinder is usually placed at its upper-limit position when the container is not in use. Erroneous push-down operation by the user can be prevented by the configuration that it becomes impossible for the push-down head to be pushed down at the upper-limit position of the cover cylinder. The height of the cover cylinder can be suitably set at the upper-limit position of the push-down head, or the push-down head can also be provided with such means as a stopper disposed on the cover cylinder so that the head cannot be pushed down.

When the user utilizes the container, one needs to rotate the rotary attachment to move the cover cylinder downward. When the push-down head becomes exposed from within the cover cylinder at the lower-limit position, the user can push down the head to perform the pumping function for discharging the contents. After the use, the rotary attachment is rotated in the reverse direction to move the cover cylinder upward.

The user can hold the container with one hand, move the cover cylinder up- and downward, and push down the head, all with fingers of one hand. Thus, for the most part, the user can handle the container only with one hand. The cover has been eliminated from this container, and there is no trouble of losing the cover or forgetting the whereabouts of the cover.

In a second exemplary embodiment, a top surface of the push-down head is positioned on the same level of, or lower than, the top surface of the cover cylinder at the upper-limit position of the cover cylinder.

This second exemplary embodiment, is a practical example of the configurations that make it impossible for the push-down head to be pushed down to discharge the contents at the upper-limit position of the cover cylinder. Because the top surface of the push-down head is positioned on the same level of, or lower than, the top brim of the cover cylinder at the upper-limit position of the cover cylinder, the top surface of the cover cylinder prevents the push-down head from being pushed down with a finger by erroneous operation. If the user tried to push down the head along with the cover cylinder, the user would perceive the resistance, and the mishandling can be prevented.

In the second exemplary embodiment, the top surface of the push-down head can be approximately on the same level as the top surface of the cover cylinder at the upper-limit position of the cover cylinder. When not in use, the cover cylinder, set at the upper-limit position, can give the appearance similar to that of a separate head cover.

In a third exemplary embodiment, the elevating system is formed by pins projecting from outer surface of the cover wall and helical slots notched in the inner wall of the rotary attachment and that the pins move along the inside of the helical slots in response to the rotation of the rotary cylinder, and thereby allow the cover cylinder to go up and down while this cover cylinder is withheld from rotating round the cap by combining vertical grooves with vertical ridges.

The above-described configuration of the third exemplary embodiment shows a practical example of the elevating system. Various types of elevating system can be adopted. Among them, the configuration of the third exemplary embodiment is often used as the mechanism for rotating lipstick of a rod type. With the rotation of the rotary attachment, the pins are guided along the helical slots, but because of a combination of vertical grooves and ridges disposed on the cover cylinder and the cap, the cover cylinder goes up and down in the vertical direction.

This elevating system allows the cover cylinder to go up and down smoothly with the rotation of the rotary attachment. By setting a short screw pitch for the helical slots, it is possible for the cover cylinder to be brought up and down at relatively weak power of fingers or even under large resistance, such as found when the cover cylinder breaks away from the climb-over locking state.

In a fourth exemplary embodiment, a climb-over locking mechanism is formed between the cover cylinder and the cap or the rotary attachment so that the cover cylinder cannot be pushed down with a finger when the climb-over locking mechanism is in action at the upper-limit position of the cover cylinder.

Based on the configuration of the fourth exemplary embodiment, the climb-over locking mechanism acting at the upper-limit position of the cover cylinder securely prevents the cover cylinder from being pushed down in an erroneous or wrong operation, thus preventing the resultant operation of the push-down head.

If such a climb-over locking mechanism is formed, the extent of this climb-over locking has to be set at a level in which the cover cylinder can easily break away from the climb-over locking state when the cover cylinder goes downward with the rotation of the rotary attachment and the action of the elevating system. In the case of an elevating system including pins and helical slots, the extent of climb-over locking can be easily set by using a short screw pitch for the helical slots so that highly resistant liberation of the cover cylinder from the climb-over locking state can be achieved by the relatively weak power of finger tips.

In a fifth exemplary embodiment, the climb-over locking mechanism is formed by an elastic locking flap device disposed in the lower portion of the cover wall and a locking ridge segment disposed in the upper portion of inner wall of the rotary cylinder and that the elastic locking flap device make a clicking sound when the flap climbs over the locking ridge segment.

The configuration of the fifth exemplary embodiment provides a practical example of the climb-over locking mechanism. The cover cylinder can be easily withheld from going up and down, by allowing the elastic locking flap device to climb over the locking ridge segment of the rotary attachment and to fit in to the locking position. When the elastic locking flap device climbs over the locking ridge segment, the device can be arranged so as to make a clicking sound. Therefore, from this sound or the feel of the hand, the user can make sure, and feel at ease, that the cover cylinder has arrived at the upper-limit position.

In a sixth exemplary embodiment, a stopper projects from the inner surface in the upper portion of the cover wall, and comes in contact with a part of the push-down head from underside at the upper-limit position of the cover cylinder.

Similarly to the fourth exemplary embodiment, the sixth exemplary embodiment provides another practical example of the means of preventing the push-down head from being pushed down at the upper-limit position of the cover cylinder. Any erroneous push-down operation of the head can be prevented by bringing the stopper projecting from the cover cylinder into contact with a part of the push-down head from underside. This configuration also prevents any erroneous or wrong operation of the push-down head, as by pushing down the head with a finger through the opening across the top surface of the cover cylinder.

In using the container, the user rotates the rotary attachment. Then, the push-down head breaks away from the contact with the stopper, and is ready to be pushed down.

This exemplary embodiments having the above-described configurations have the following effects:

The first exemplary embodiment enables the user to move the cover cylinder up- and downward and to push down the head, by using fingers of one hand while holding the container with the hand. On the whole, the user can handle the container with one hand. Furthermore, this container ensures that the erroneous operation of the push-down head is prevented at the upper-limit position of the cover cylinder. Since the separate head cover is eliminated, the user does not have to be embarrassed by losing the cover or forgetting the whereabouts of the cover.

In the second exemplary embodiment, the top surface of the cover cylinder prevents the push-down head from being pushed down with a finger by an erroneous operation. When the container is not in use, the cover cylinder can be put back at its upper-limit position. In that state, the cover cylinder has the same appearance as a separate head cover that has been fitted to the neck of the container.

In the third exemplary embodiment, the cover cylinder can be moved up and down smoothly by the rotation of the rotary attachment as long as the container is provided with an elevating system comprising screw slots and pins.

In the fourth exemplary embodiment the climb-over locking mechanism acting at the upper-limit position of the cover cylinder securely prevents the cover cylinder from being pushed down in an erroneous or wrong operation.

In the fifth exemplary embodiment the cover cylinder can be easily withheld from going up and down, by allowing each elastic locking flap device to climb over the locking ridge segment of the rotary attachment and to fit in to the locking position. The elastic locking flap device can be arranged so as to make a clicking sound. From this sound or the feel of the hand, the user can make sure, and feel at ease, that the cover cylinder has arrived at the upper-limit position.

In the sixth exemplary embodiment any erroneous or wrong push-down operation, as by pushing down the head with a finger through the opening across the top brim of the cover cylinder, can be prevented by using the stopper projecting from the cover cylinder and by bringing the stopper into contact with a part of the push-down head from underside.

BRIEF DESCRIPTION OF THE DRAWINGS

FIG. 1 is a side elevational view of the container in one embodiment of this invention, including partially a longitudinal section.

FIG. 2 is a side elevational view showing the container of FIG. 1 in which the cover cylinder is at its lower-limit position.

FIG. 3 is a plan view of the container shown in FIG. 1.

FIG. 4 is a plane cross-sectional view of the container of FIG. 1, taken along the line A-A in FIG. 2.

FIG. 5 is a perspective view of the entire cover cylinder shown in FIG. 1.

FIG. 6 is a perspective view of the rotary attachment shown in FIG. 1, including a partially broken-out section.

FIG. 7 is a longitudinal section of an important part showing a climb-over locking state based on elastic locking flap mechanism shown in FIG. 1.

DETAILED DESCRIPTION OF EMBODIMENTS

With reference to the drawings, the exemplary embodiments are further described. FIGS. 1-7 show the dispensing container. The dispensing container has six components, including a cap 11, a cover cylinder 21, a rotary attachment 31, a push-down head 41, a manual pump 51 of a push-down type, and a gasket 53, in addition to the main container 1 of a synthetic resin.

The main container 1 in the shape of a bottle includes a cylindrical body 3, a neck 2 standing upright from the body 3 and having an engaging ridge 2*a* disposed around the outer surface in the upper neck portion, and a bottom 4 sealed by a bottom plate 6 in the shape of a bottomed cylinder. A bottom lid 5 disposed inside the bottom is configured to slide upward in tight contact with the inner surface of the body 3 as the consumption of, and decrease in, the contents go on. Use of such a bottom lid 5 in the inside enables the pump 51 to discharge the contents even in the inverted state. For the applications in which the container is used only in the upright posture, the bottles having an ordinary bottom 4 can be utilized.

The cap 11 has a cylindrical attaching cylinder 12, which is fitted around the neck 2 and is secured by an engaging ridge 2*a*. A part of the wall of the attaching cylinder 12 is missing, and is called a cutout section 14. At the lower end of the attaching cylinder 12, there is a base cylinder 17, which is disposed vertically and is connected to the attaching cylinder 12 by an outer brim 17*a*. An inner cylinder 15 is coaxially disposed inside the attaching cylinder 12 and is connected thereto by way of an inner brim 15*a*. The inner cylinder 15 has approximately the same height as the upper portion of the attaching cylinder 12. On the outer peripheral wall of this inner cylinder 15 there is a pair of vertical grooves that are notched at axisymmetrical positions. It should be noted that the attaching cylinder 12 may also be fitted to the neck 2 by screw engagement.

As shown in FIG. 6, the rotary attachment 31 has a rotary cylinder 32, and is fitted to the cap 11 in a rotatable manner through the engagement of an engaging ridge 35 with a base cylinder 17. A pair of helical slots 33 is disposed at axisymmetrical positions in the inner wall of the rotary attachment 31. A locking ridge segment 34 is disposed around the inner wall in the upper portion of the rotary cylinder 32, and as later described, a elastic locking flap device 24 of the cover cylinder 21 climbs over these locking ridge segment 34. In this embodiment, two helical slots 33 are used, but three helical slots may be notched, giving consideration to further stability of the rotation. The number and pitch of the helical slots 33 are a matter of design to be decided while taking the mode of use and material moldability, etc. into consideration.

The cover cylinder 21 shown in FIG. 5 has a cylindrical cover wall 22, which is disposed coaxially between the attaching cylinder 12 and the rotary cylinder 32 in a manner that the cover wall 22 can go up and down. A pair of pins 23 in the shape of a short column projects from the outer surface in the lower portion of the cover wall 22, and is fitted to the respective helical slots 33 in a manner capable of sliding upward and downward. An elastic locking flap device 24 is formed right above each pin 23. A pair of vertical ridges 26 (See also FIG. 4) is formed in the inner surface of the cover wall 22 at positions of a central angle of 90 degrees from the positions of the pins 23 so that the vertical ridges 26 can be fitted into vertical grooves 13 of the attaching cylinder 12 of the cap 11 in a manner capable of going up and down.

The push-down head 41 has a head cylinder 42 in the shape of a roofed circular cylinder. A sealing cylinder 46 is tightly fitted around the upper portion of the pump 51 to secure the pump 51. A discharge port 44 is formed in the lateral direction at the upper end of the sealing cylinder 46. A pair of vertical ridges 43 is disposed axisymmetrically on the inner surface of the head cylinder 42, and is fitted into the vertical grooves 16 notched in the inner cylinder 15 of the cap 11 in a manner capable of going up and down (See FIG. 4).

The manual pump 51 of the push-down type is fitted to the neck 2 by having a flange 52 and a gasket 53 sandwiched between the top face of the neck 2 and the underside of the inner brim 15*a*.

The above-described components, including the main container 1, the cap 11, the cover cylinder 21, the rotary attachment 31, the push-down head 41, the pump 51, and the gasket 53, are assembled into the dispensing container. Next, the usage of the dispensing container is described below. FIG. 1 shows the dispensing container, which is left unused. The cover cylinder 21 is at the upper-limit position. The top brim of the cover cylinder 21 is on the same level of the top surface of the push-down head 41. Because the cover cylinder 21 surrounds the side wall of the push-down head 41, the head portion gives neat appearance as if the head has been covered by a separate head cover.

In this state, the elastic locking flap devices 24 of the cover cylinder 21 have climbed over the locking ridge segments 34 of the rotary attachment 31 and settled in the locking place. In addition, the stopper 25 of the cover cylinder 21 comes in contact with the front portion of the discharge port 44 of the push-down head 41 from underside to prevent the push-down head 41 from being pushed.

In time of using the dispensing container, the user holds the container with one hand and makes the rotary attachment 31 turn counter-clockwise, using fingers of the hand. Then, the elastic locking flap devices 24 break away from the locking engagement with the locking ridge segment 34. The elevating system comprising the pins 23, the helical slots 33, the vertical grooves 13 of the attaching cylinder 12, and the vertical ridges 26 of the cover cylinder 21 goes into action, and the cover cylinder 21 vertically descends and arrives at its lower-limit position. In this embodiment, the vertical grooves 13 are formed in the attaching cylinder 12, and the vertical ridges 26 are formed on the cover cylinder 21. Instead, the vertical ridges of the attaching cylinder 12 can be combined with the vertical grooves of the cover cylinder 21.

With the arrival of the cover cylinder 21 at its lower-limit position, the push-down head 41 is exposed out of the cover cylinder 21 and found projecting upward, and the contact with the stopper 2 is broken away. If the top surface of the head 41 is pushed down under this condition, then the vertical ridges 43 moves downward along the vertical grooves 16 of the inner cylinder 15, and thus, the head 41 can be pushed down while keeping a stable posture. As a result, the contents are discharged through the discharge port 44. At that time, the front portion of the discharge port 44 is fitted in the cutout section 14 of the attaching cylinder 12.

The elevating system utilizes mainly the helical slots 33 to convert rotation to vertical movement. If the extent of climb-over makes it impossible to push down the cover cylinder 21 directly, there is a need to adjust the pitch of the helical slots 33. After appropriate adjustment, ordinary force of fingers is sufficient to enable the elastic locking flap device 24 to break away from the climb-over locking.

After the use, the rotary attachment 31 is rotated clockwise to move up the cover cylinder 21 to the upper-limit position. Here the elastic locking flap device 24 climb over the locking ridge segment 34 and settle in the locking place. At that time, the front edge of the elastic locking flap device 24 makes a clicking sound the moment the flap elastically returns from the elastic deformation state shown by a chain double-dashed line (See FIG. 7). Therefore, from this sound or the feel of the hand, the user can make sure, and feel at ease, that the cover cylinder has arrived at the upper-limit position.

It is to be understood that the action and effect of this invention are not limited to the above-described embodiments. The pump(s) used in the exemplary embodiments, for example, are illustrative only. Manual pumps of various types have been conventionally used for the dispensing containers, and can be used also in this invention. The embodiments of this invention have the configuration that the top brim of the cover cylinder located at its upper-limit position is set on the same level as the top surface of the push-down head. If necessary from an application or designing point of view, the push-down head can be disposed so as to project from the top brim of the cover cylinder, as by disposing the stopper at an appropriate position within a range in which the head cannot be pushed down to discharge the contents.

The dispensing container with a pump according to the exemplary embodiments can be handled with only one hand. Unlike the conventional dispensing containers, there is no trouble of losing the cover or forgetting whereabouts of the cover. Therefore, the container of this invention can be used with ease that has not been experienced before. For example, a wide range of applications, such as cosmetic use, can be expected.

The invention claimed is:

1. A dispensing container with a pump, comprising:

a neck standing on the upper portion of a main container and having a manual pump of a push-down type disposed upright in said neck;

a push-down head fitted to the top of said pump;

a cap having an attaching cylinder fitted around said neck and having said pump fitted and secured to the neck in a sealed state;

a rotary attachment having its lower portion fitted around the lower portion of the cap in a rotatable manner and having a rotary cylinder disposed on the outside of the attaching cylinder coaxially on central axis; and a cover cylinder having a cover wall disposed coaxially between the attaching cylinder and the rotary cylinder in a manner capable of going up and down under the condition that an elevating system has been established with the attaching cylinder and the rotary cylinder by the rotary movement of the rotary attachment, wherein said cover cylinder is set up in such a way that the push-down head is exposed out of the cover cylinder at its lower-limit position and a stopper projects from the inner surface of the cover wall, and comes in contact with a part of the push-down head from underside at an upper-limit position of the cover cylinder to prevent contents from being discharged by error, and the stopper prevents a downward pushing motion on the push-down head when the cover cylinder is at the upper-limit position.

2. The dispensing container with a pump, according to claim 1, wherein at the upper-limit position of the cover cylinder, top surface of the push-down head is positioned on the same level of, or lower than, the top surface of the cover cylinder.

3. The dispensing container with a pump, according to claim 1, wherein the elevating system is formed by pins projecting from outer surface of the cover wall and helical slots notched in the inner wall of the rotary cylinder, and wherein said pins move along the helical slots in response to the rotation of the rotary attachment, and thereby allow the cover cylinder to go up and down while this cover cylinder is withheld from rotating round the cap by combining vertical grooves with vertical ridges.

4. The dispensing container with a pump, according to claim 1, wherein a climb-over locking mechanism is formed between the cover cylinder and the cap or the rotary attachment so that the cover cylinder cannot be pushed down with a finger when the climb-over locking mechanism is in action at the upper-limit position of the cover cylinder.

5. The dispensing container with a pump, according to claim 4, wherein the climb-over locking mechanism is formed by a elastic locking flap device disposed in the lower portion of the cover wall and a locking ridge segment disposed in the upper portion of inner wall of the rotary cylinder and wherein the elastic locking flap device makes a clicking sound when the flap climbs over the locking ridge segment.

* * * * *